US005292049A

United States Patent [19]

Simon

[11] Patent Number: 5,292,049

[45] Date of Patent: Mar. 8, 1994

[54] PLATE DRIVER HEAD

[75] Inventor: Rodolphe Simon, Stockton Springs, Me.

[73] Assignee: Kenney/Williams/Williams Inc., Maple Glen, Pa.

[21] Appl. No.: 991,823

[22] Filed: Dec. 16, 1992

[51] Int. Cl.[5] ..... B25C 1/04

[52] U.S. Cl. ..... 227/147; 227/113

[58] Field of Search ..... 227/129, 113, 147; 404/133.05, 133.1; 81/20, 24, 26; 29/254, 275

[56] References Cited

U.S. PATENT DOCUMENTS

| | | | |
|---|---|---|---|
| 1,107,976 | 8/1914 | McCoy | 404/133.1 |
| 2,919,613 | 1/1960 | Crement | 81/26 |
| 3,259,035 | 7/1966 | Pfundt | 404/133.1 |
| 4,082,471 | 4/1978 | Hiszpanski | 404/133.1 |
| 4,611,739 | 9/1986 | Rowton | 227/113 |

*Primary Examiner*—Richard K. Seidel

*Assistant Examiner*—Allan M. Schrock

*Attorney, Agent, or Firm*—Cornelius J. Husar

[57] ABSTRACT

The disclosure relates to a plate driver head and more specifically to a plate driver head for use with a power impact tool. The plate driver head includes a steel head portion and a shank portion which can be received in most commercially available power impact tools. The drive head is provided with supporting gussets on opposite sides of the shank which extend to the upper surface of the head to provide uniform pressure distribution over the entire head work surface. The head is magnetized to hold the workpiece steady while being inserted into a surface. Several embodiments are disclosed, one of which is a flat uninterrupted work driving surface while another embodiment includes a recess in the driving surface to accommodate different configured workpieces without damaging them during the insertion procedure.

10 Claims, 1 Drawing Sheet

PLATE DRIVER HEAD

CROSS-REFERENCE TO RELATED APPLICATION

The subject matter of the instant application is related to Building Enclosure Assemblies, of the type disclosed in commonly-owned application Ser. No. 07/904598, filed Jun. 26, 1992.

BACKGROUND OF THE INVENTION

There is presently considerable interest in the commercial building industry in demountable wall systems wherein after a wall system has been installed it may, after a given period of time, be desired to relocate or completely remove the wall system which has been installed without destroying the materials used in the wall system. There is also considerable interest in a gypsum-fiber wallboard which is made of ground, shredded, waste paper with a gypsum binder and produced into the usual four foot by eight foot or four foot by twelve foot sheets.

The related above-identified co-pending application is directed to such a demountable wall system using either traditional wallboard material or the gypsum fiber wallboard just described. Additionally, instead of the typical metal "C - studs" frequently used, a specialized stud shape in the general configuration of two hollow isosceles triangles joined by a web member is utilized in this type of wall system. This "hourglass" shaped stud member includes slots to receive clips which are required in this type of construction.

In order to securely attach these clips to the wallboard members, pronged nail plates are required to be securely fastened at predetermined locations to the back sides of the wallboard sections which make up the wall system. It is this particular use for which the instant invention has been developed. However, it may find use in many other areas of the construction industry as well.

SUMMARY OF THE INVENTION

The present invention relates to a plate driver head which includes a shank portion that can readily be received in a conventional commercially available power impact tool. As indicated above, the plate driver head finds particular use in a demountable wall system where pronged nail plates are required to be inserted into the rear face of wallboard at predetermined locations to facilitate attachment of clips thereon. The plate driver head comprises a rectangular steel head portion and a shank portion extending perpendicularly therefrom. Reinforcing gussets are provided on each side of the shank portion and securely welded to the head and shank portion to provide stability and support when in use. The head portion is magnetized to enable the user to merely grasp a pronged plate with the prongs facing away from him, place the flat portion of the pronged plate against the magnetized head and then, using both hands, grasp the impact tool securely and pull the trigger and hold it back until the pronged plate is driven flush with the wallboard surface.

One embodiment of the plate driver head is flat over the entire surface while another embodiment has a central raised portion therein to accommodate different configurations of pronged plates.

OBJECTS OF THE INVENTION

An object of the invention is to provide a tool which facilitates the insertion of pronged plates into wallboard.

Another object of the invention is to provide a tool having a standard shank size permitting its use with commercially available power impact tools.

A further object of the invention is to provide a plate driver head which applies uniform pressure over the entire surface of the driven object without damaging the wallboard.

Yet another object of the invention is to provide a plate driver head which is magnetized to hold the driven object thus freeing the user's hand.

Another object of the invention is to provide a plate driver head which when used with a power impact tool permits the fast and efficient installation of pronged nail plates.

A still further object of the invention is to provide a plate driver head which can accommodate pronged plates having raised portions without damaging the raised portions thereon.

These and other objects of the invention will become more apparent hereinafter. The instant invention will now be described with particular reference to the accompanying drawings which form a part of this specification wherein like reference characters designate the corresponding parts in the several views.

DETAILED DESCRIPTION OF THE DRAWINGS

Figure 1:
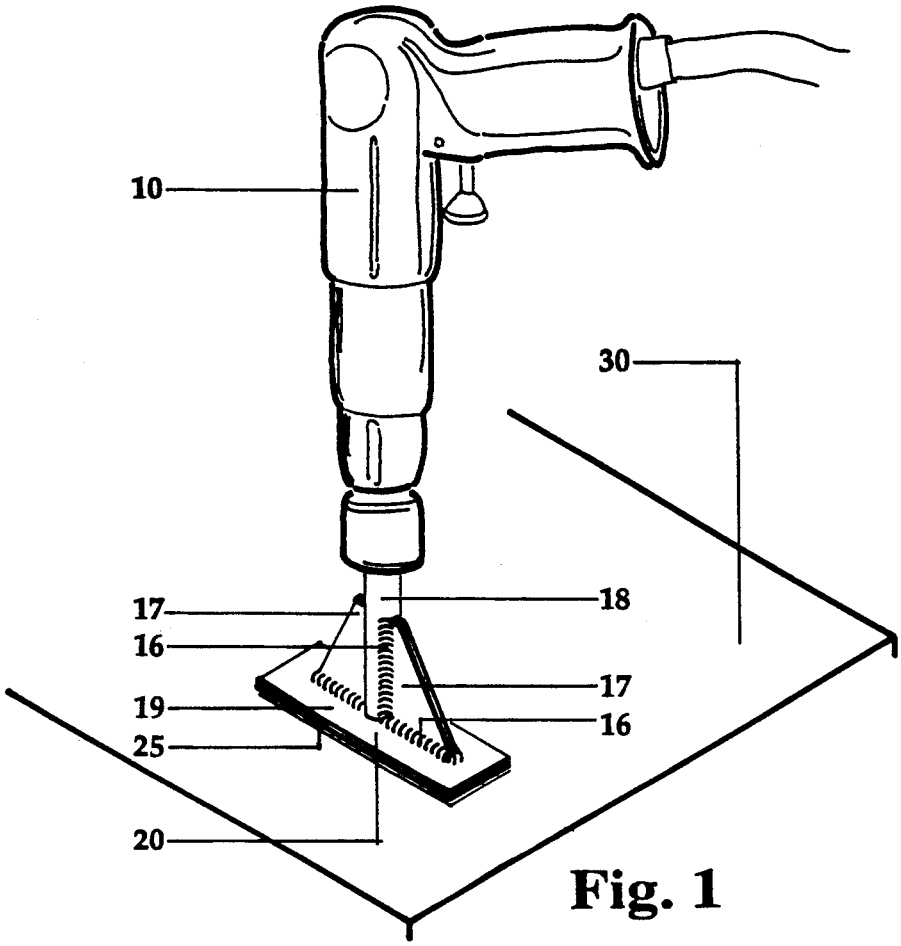
FIG. 1 is a perspective view illustrating the manner of using the novel plate driver head.

Referring now to FIG. 1, there is shown a perspective view of the impact tool 10 which is a standard commercially available tool of the power impact type. As illustrated, the novel plate driver head has been inserted into the holder of impact tool 10.

Plate driver head 20 includes a flat driving plate portion 19 which has a shank 18 extending upwardly therefrom at a right angle. A pair of triangular gussets 17 are used to provide lateral support to shank 18 relative to driving plate portion 19. The base of gussets 17 serves to distribute the impact over driving plate portion 19 thus ensuring uniform force distribution over pronged nail plate 25. In order to allow the user to place both hands on impact tool 10 during the driving operation, plate driving portion 19 is magnetized to securely hold nail plate 25 in contact with driving plate portion 19 once so placed. Weld beads 16 are used to interconnect gussets 17 with shank 18 and driving plate 19.

As illustrated in FIG. 1, pronged nail plate 25 has been placed into contact with driving plate portion 19 in preparation for driving pronged nail plate 25 into wallboard 30. Driving plate portion 19 conforms to the dimensions of pronged nail plate 25 providing full contact with the entire surface of pronged nail plate 25 and uniform pressure distribution, resulting in a smooth insertion of pronged nail plate 25 into wallboard 30.

Figure 2:
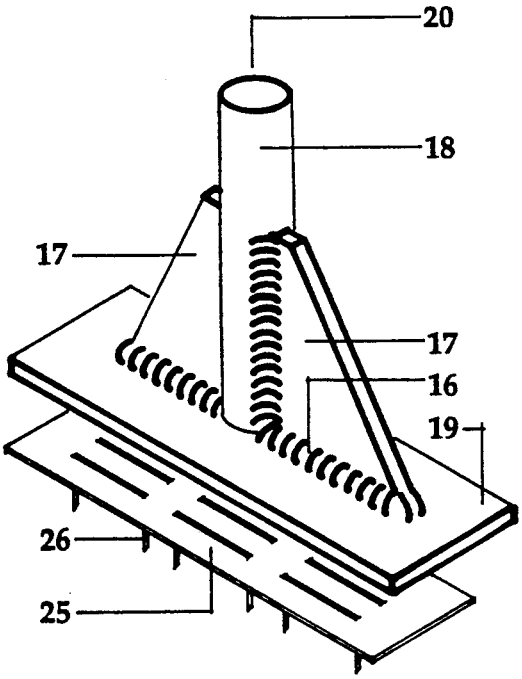
FIG. 2 is a perspective view of the novel plate driver head per se.

Turning now to FIG. 2, there is shown an illustration of the plate driver head 20 and a closer view of pronged nail plate 25. As indicated above, driving plate portion 19 is magnetized and the illustration is prior to pronged nail plate 25 being brought into contact with driving plate portion 19. Although not shown in this view, the bottom surface of driving plate portion 19 is an uninterrupted flat surface which permits full surface contact with pronged nail plate 25. Pronged nail plate 25 is a commercially available steel nailing plate wherein prongs 26 have been punched out in the manufacturing process. Prongs 26 serve as the anchoring means for pronged nail plates 25 after it has been driven into wallboard 30.

Figure 3:
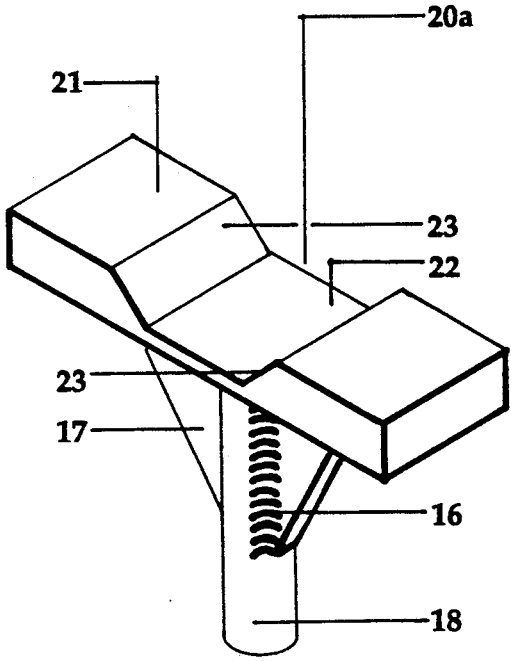
FIG. 3 is a plan view of the underside of another embodiment of the plate driver head.

Referring now to FIG. 3, there is illustrated a bottom view of another embodiment designated 20A. The structure of plate driver heads 20 and 20A is identical except for the contour of the bottom driving surface. As shown in FIG. 3, bottom surface 21 is discontinuous to provide a central raised portion 22 which begins with two tapered surfaces 23 which taper inwardly at an angle of forty five degrees toward the centerline of shank 18 with a flat horizontal surface 22 interconnecting the lower ends of said tapered surfaces 23.

The embodiment of FIG. 3 is provided to accommodate pronged nail plates which have a raised central portion which is received in raised central portion 22 of plate driver head 20A. Driver plate head 20A is also made of steel and is magnetized for use in the same manner as set forth in the description of FIGS. 1 and 2.

It can readily be seen that applicant's novel plate driver heads 20 and 20A provide a means whereby a workman can with a minimum amount of time and effort quickly and efficiently install a number of pronged nail plates 25 without damage to the wallboard or the pronged nail plates 25.

While the invention has been described in its preferred embodiments, it is to be understood that the words which have been used are words of description rather than limitation and that changes may be made within the puriew of the appended claims without departing from the full scope or spirit of the invention.

Having thus described my invention, I claim:

1. An apparatus for driving a plate comprising a hand held power impact tool, a plate driver head for use with said hand held power impact tool wherein said plate driver head comprises a driving means having an upper surface and a lower surface; a shank portion centrally positioned on said upper surface and extending perpendicularly therefrom; pressure distribution and support means securely attached to said upper surface of said driving means and said shank portion, and holding means for holding a workpiece in place relative to said plate driver head; said holding means defined by a pair of oppositely disposed planar surfaces in a first plane separated by a centrally located intermediate planar portion in a second plane having transition portions connecting said three planar surfaces whereby after inserting said shank portion into a power impact tool and placing a workpiece against the lower surface of said driving portion means an operator can hold a workpiece and by depressing the actuating means of said power impact tool drive said workpiece into a wallboard panel.

2. An apparatus for driving a plate as defined in claim 1 wherein said two oppositely disposed planar surfaces are on the same plane and said intermediate planar portion is parallel thereto.

3. An apparatus for driving a plate as defined in claim 1 wherein said pressure distribution and support means includes gusset means which are welded to said shank portion and said upper surface of said driving means thereby providing a uniform distribution of force to said flat driving head means.

4. An apparatus for driving a plate as defined in claim 3 wherein said gussett means comprises a plurality of triangular members, each having a base and a side portion interconnected by a hypotenuse portion; said base portion securely attached to said upper surface of said driving means and said side portion securely attached to said shank portion by weldments along points of contact.

5. An apparatus for driving a plate as defined in claim 4 wherein the number of said plurality of triangular members is two with each of said triangular members oppositely disposed relative to said shank portion.

6. An apparatus for driving a plate as defined in claim 1 wherein said holding means is made of steel and has been magnetized to attract and securely hold metallic objects which have been brought into contact therewith.

7. An apparatus for driving a plate as defined in claim 1 wherein said pressure distribution and support means includes gusset means which are welded to said shank portion and said upper surface of said driving means thereby providing a uniform distribution of force to said driving means.

8. An apparatus for driving a plate as defined in claim 7 wherein said gussett means comprises a plurality of triangular members, each having a base and a side portion interconnected by a hypotenuse portion; said base portion securely attached to said upper surface of said driving means and said side portion securely attached to said shank portion by weldments along points of contact.

9. An apparatus for driving a plate as defined in claim 8 wherein the number of said plurality of triangular members is two with each of said triangular members oppositely disposed relative to said shank portion.

10. An apparatus for driving a plate as defined in claim 1 wherein said holding means is made of steel and has been magnetized to attract and securely hold metallic objects which have been brought into contact therewith.

* * * * *